US005880764A

United States Patent [19]

Barinaga

[11] Patent Number: 5,880,764

[45] Date of Patent: Mar. 9, 1999

[54] ADAPTIVE INK SUPPLY FOR AN INK-JET PRINTER

[75] Inventor: John A. Barinaga, Corvallis, Oreg.

[73] Assignee: Hewlett-Packard Company, Palo Alto, Calif.

[21] Appl. No.: 567,556

[22] Filed: Dec. 4, 1995

[51] Int. Cl.[6] ..... B41J 2/195

[52] U.S. Cl. ..... 347/86; 347/87; 347/49

[58] Field of Search ..... 347/86, 87, 49, 347/50

[56] References Cited

U.S. PATENT DOCUMENTS

| | | | |
|---|---|---|---|
| D. 353,156 | 12/1994 | Kaplinsky et al. . | |
| 4,156,244 | 5/1979 | Erikson et al. . | |
| 4,500,895 | 2/1985 | Buck et al. . | |
| 4,513,297 | 4/1985 | Okamura . | |
| 4,673,955 | 6/1987 | Ameyama et al. . | |
| 4,689,642 | 8/1987 | Sugitani . | |
| 4,709,245 | 11/1987 | Piatt . | |
| 4,719,475 | 1/1988 | Kiyohara et al. . | |
| 4,771,295 | 9/1988 | Baker et al. . | |
| 4,831,389 | 5/1989 | Chan . | |
| 4,992,802 | 2/1991 | Dion et al. . | |
| 5,119,115 | 6/1992 | Buat et al. . | |
| 5,155,502 | 10/1992 | Kimura et al. . | |
| 5,359,357 | 10/1994 | Takagi et al. | 347/49 |
| 5,434,603 | 7/1995 | Hunt . | |

FOREIGN PATENT DOCUMENTS

| | | | |
|---|---|---|---|
| 979151 A3 | 7/1990 | European Pat. Off. | B41J 2/005 |
| 546832A3 | 6/1993 | European Pat. Off. | B41J 2/175 |
| 623471A3 | 11/1994 | European Pat. Off. | B41J 2/175 |
| 57-069086 | 4/1982 | Japan | B41J 3/04 |
| 5-057885 | 3/1993 | Japan | B41J 2/01 |

*Primary Examiner*—Peter S. Wong
*Assistant Examiner*—Rajnikant B. Patel

[57] ABSTRACT

An adaptive ink supply for an ink-jet printer is provided with the receptacle mountable to an ink-jet printer. The receptacle has four ink chambers for receiving ink cartridges having flexible ink reservoirs supported by a rigid frame. The receptacle chambers have spring-loaded pressure plates on either side of the chamber for pressurizing ink cartridges inserted therein. The ink cartridges are coupled to a fluid outlet which is normally closed to prevent the flow of ink. When the ink cartridge is inserted into a receptacle mounted to a printer, the fluid outlet establishes a fluid connection between the ink cartridge and the printer. The pressure plates exert a force against the ink cartridge causing ink to flow from the cartridge and to the printer.

15 Claims, 5 Drawing Sheets

ADAPTIVE INK SUPPLY FOR AN INK-JET PRINTER

FIELD OF THE INVENTION

The present invention relates to an adaptive ink supply for an ink-jet printer.

BACKGROUND AND SUMMARY OF THE INVENTION

Ink-jet printers have become established as reliable and efficient devices. Typically, an inkjet printer utilizes a pen mounted on a carriage which is moved relative to a printing surface. The pen carries a print head. A control system activates ink jets on the printhead at the appropriate locations, causing the printhead to eject ink drops onto the printing surface to form desired images and characters.

This invention is concerned with ink jet printers that have ink supplies that are not mounted to the carriage. Such ink supplies are often referred to as "off-axis" ink supplies. Ink is directed from the supply to the printhead through a tube that trails from the pen. Ink may be supplied to the printhead by a variety of methods such as, for example, a pump that is adjacent to the supply.

SUMMARY OF THE INVENTION

The present invention is directed to an off-axis ink supply for a ink-jet printer that reliably provides a supply of ink for an inkjet pen. The supply is made up of one or more cartridges of ink (one cartridge having black ink, one having cyan ink, etc.). The adaptive ink supply includes a cartridge receptacle that fits within an ink-jet printer. The cartridge receptacle has several chambers, each capable of receiving and pressurizing an ink cartridge.

The cartridges used with the receptacle include a flexible ink reservoir for storing ink. The cartridge additionally includes an outlet that couples to an ink inlet that is located on an ink-jet printer. When the receptacle is mounted to a printer with ink cartridges inserted into the chambers within the receptacle, the pressurized ink within the cartridge flows from the reservoir to the pen.

Other objects and aspects of this invention will become apparent to those skilled in the art from the detailed description which is presented by way of example and not as a limitation of the present invention.

DESCRIPTION OF PREFERRED EMBODIMENTS

Figure 1:
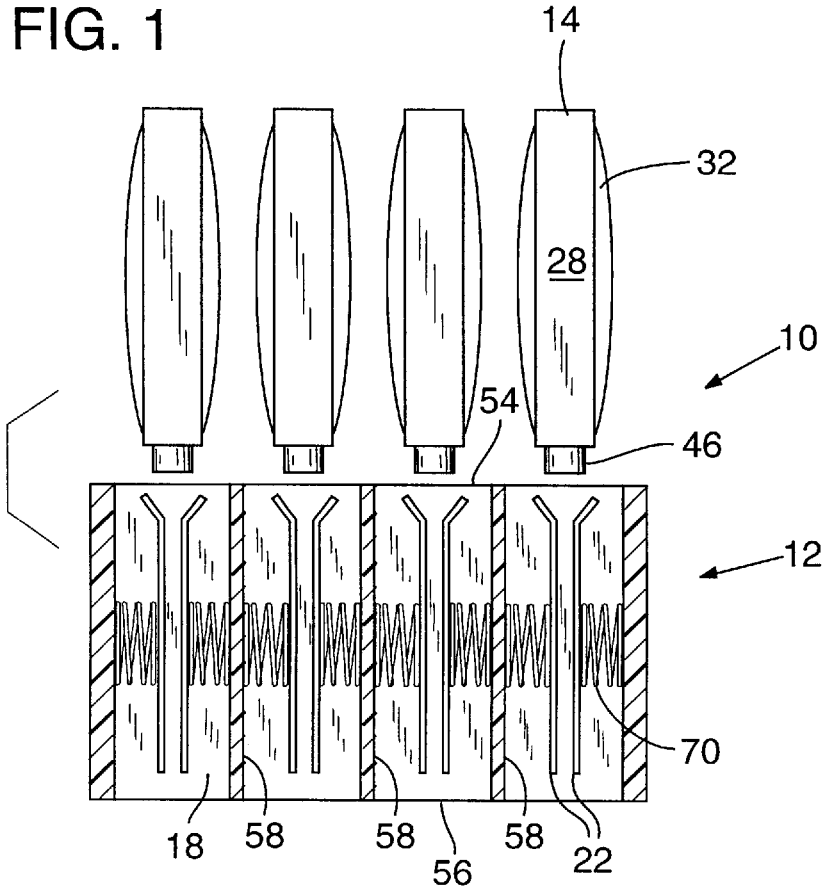
FIG. 1 is a cross-sectional side view of a preferred embodiment of the adaptive ink supply.

In accordance with a preferred embodiment of the present invention, an adaptive ink supply 10 is illustrated in FIG. 1.

The adaptive ink supply 10 comprises a receptacle 12 and an ink cartridge 14. The receptacle 12 is intended for use with a color printer. Typically, color printers use combinations of four ink colors. Thus, in a preferred embodiment, the receptacle 12 has four side-by-side ink chambers 18, each of which can receive one ink cartridge 14. Each chamber 18 includes a pair of spring-loaded pressure plates 22. Pressure plates 22 are positioned within chamber 18 such that, when an ink cartridge 14 is inserted in a chamber, the pressure plates exert a force on either side of the cartridge.

Each ink cartridge 14 has a hard frame 28 (FIGS. 1 and 3) that supports a pair of plastic sheets to define a flexible reservoir 32 for storing ink. A fluid outlet 46 is connected to the bottom of frame 28.

Figure 3:
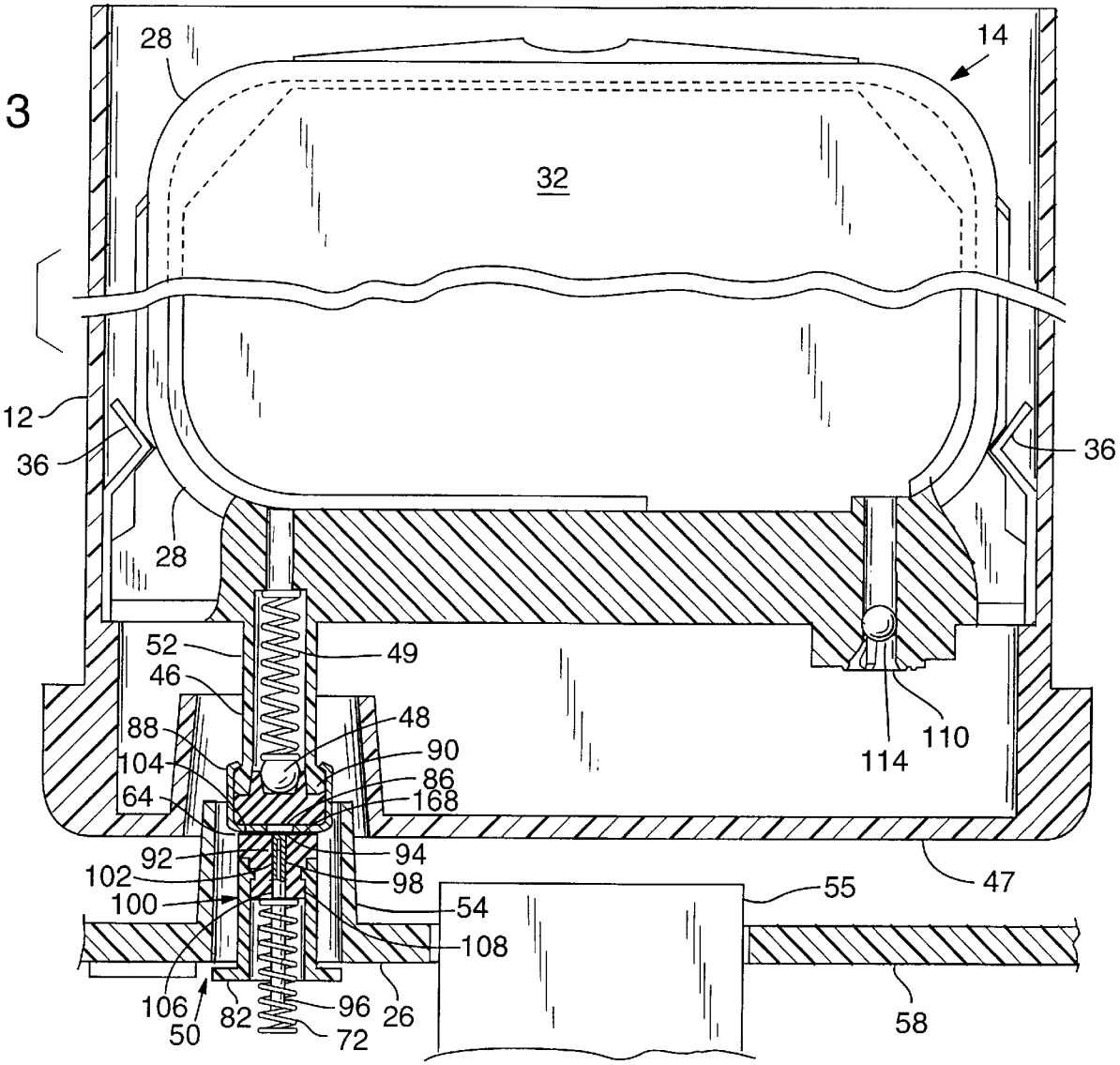
FIG. 3 is a cross-sectional side view of a preferred embodiment of an ink cartridge of the adaptive ink supply, the ink cartridge shown inserted in a receptacle that is docked in a docking bay of a printer.
Figure 4:
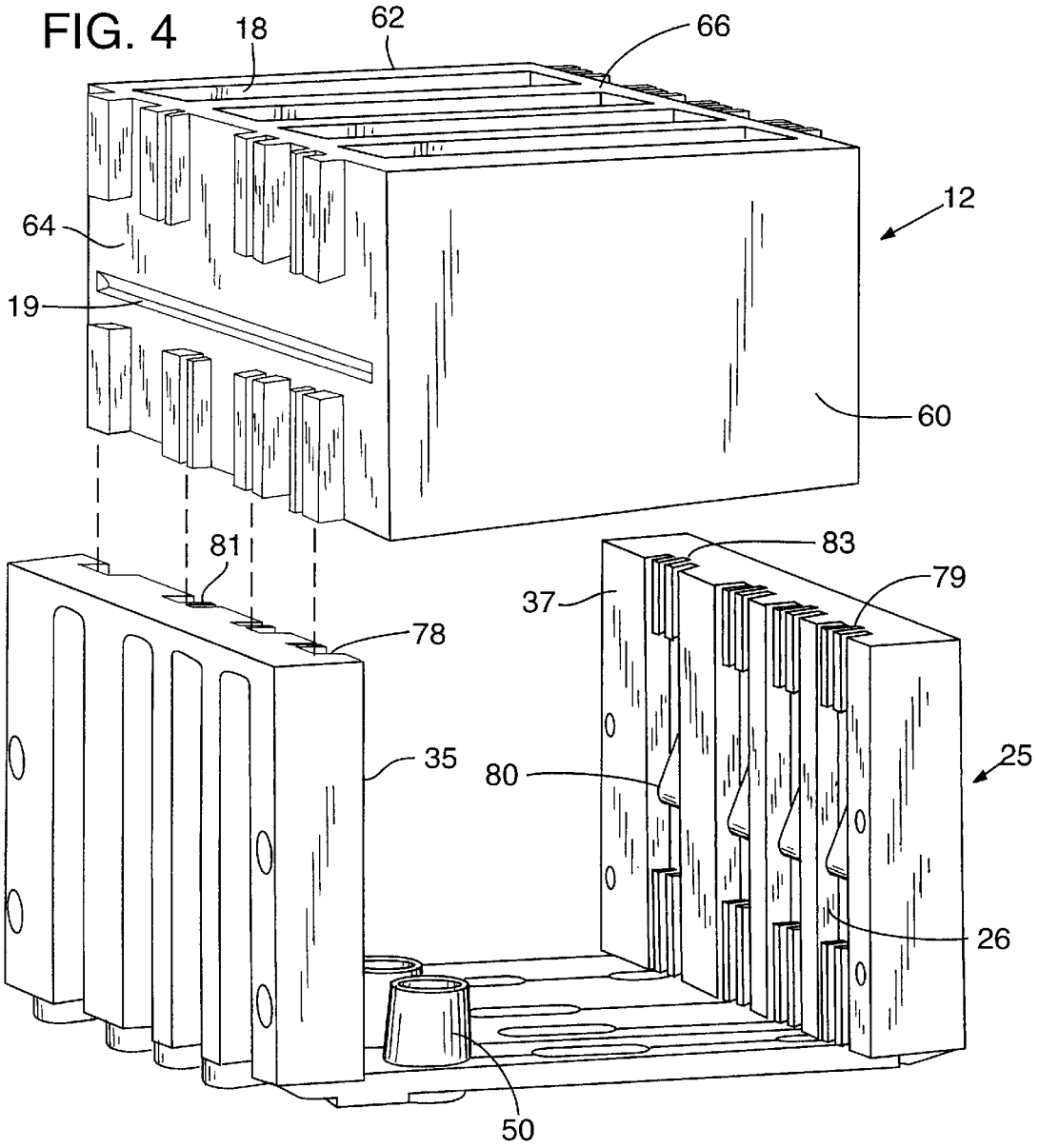
FIG. 4 is a perspective view of a preferred embodiment of the adaptive ink supply illustrating the docking of a receptacle on the printer.

Referring to FIGS. 3 and 4, a docking station 25 located on an ink-jet printer includes four side-by-side docking bays 26. Each docking bay 26 has a fluid inlet 50. The fluid outlet 46 of a cartridge 14 mates with the fluid inlet 50 of a docking bay. The docking station 25 is described more fully below.

The receptacle 12 is mounted to the docking station 25. After receptacle 12 is mounted to the docking station, an ink cartridge 14, containing the appropriate ink color, is inserted into a chamber 18 such that fluid outlet 46 aligns with fluid inlet 50.

Pressure plates 22 on either side of the chamber 18 pressurize the flexible ink reservoir 32 of the inserted ink cartridge 14 to cause the ink to flow from the reservoir 32 of the cartridge, through the fluid outlet 46, the fluid inlet 50, and to the printer.

The receptacle 12, having an open top 54 and an open bottom 56, includes a framework 28 that is substantially rectangular in shape. Ends 60 and 62 and sides 64 and 66 of receptacle 12 all extend from the top 54 to the bottom 56 of the receptacle. Preferably, receptacle 12 is about 115 mm in height, about 95 mm in length (between ends 60 and 62), and about 90 mm in width (between sides 64 and 66). The illustrated receptacle 12 is made of a fairly rigid material such as, for example, high density polyethylene, polypropylene or polysulfone.

Each chamber 18 defined in the receptacle (FIGS. 1 and 2) is separated from adjacent chambers by partition walls 58, made of the same material as the receptacle framework 28 described above, or any suitably rigid material. To define the four chambers 18, three partition walls 58 extend along the vertical axis of receptacle 12 (i.e., from the top 54 to the bottom 56), substantially parallel with ends 60 and 62 (FIG. 2) and evenly spaced apart. Additionally, partition walls 58 extend substantially perpendicular to the horizontal axis of receptacle 12, extending from side 64 to side 66.

The two inner chambers are defined by the receptacle sides 64 and 66 and partition walls 58. The two outermost chambers are defined by the receptacle sides 64 and 66, ends 60 and 62 and the partition walls. Each chamber 18 is preferably about 115 mm in height, about 20 mm in width and about 80 mm in length. Of course, in other embodiments, other materials and configurations for the receptacle 12 and the chambers therein, may be used.

Figure 2:
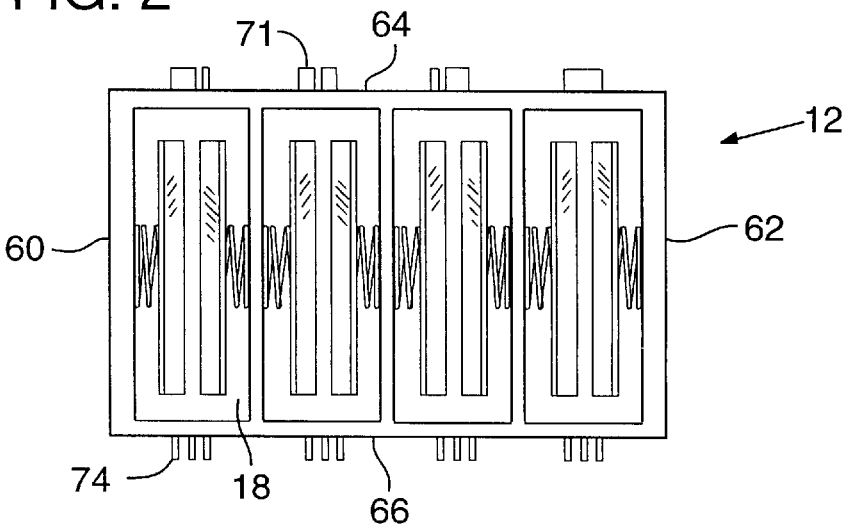
FIG. 2 is a top view of a preferred embodiment of a cartridge receptacle of the adaptive ink supply.

Each chamber 18 includes two spring-loaded pressure plates 22 mounted to opposing chamber walls (FIGS. 1 and 2). The pressure plates 22 extend along the vertical axis of receptacle 12, substantially parallel with ends 60 and 62 and perpendicular to the sides 64, 66. The tops and bottoms of the pressure plates 22 are somewhat recessed relative to the respective top 54 and bottom 66 of receptacle 12. Pressure plates 22 extend just short of either side 64 and 66 of receptacle 12.

In the illustrated embodiment each pressure plate 22 is mounted to, and biased by, a helical spring 70, disposed between the pressure plate and the adjacent chamber wall. The helical spring 70, made of stainless steel, urges the attached pressure plate 22 in a direction toward the center of chamber 18 so that, when an ink cartridge is inserted between two plates in the chamber, the pressure plates exert pressure on either side of the flexible ink reservoir 32.

In a preferred embodiment, the plates 22 have diverging upper ends, thereby to facilitate insertion of a cartridge therebetween.

The receptacle 12, in the illustrated embodiment, also includes sets of projecting keys 74 on the exterior of one side 66 (FIGS. 2 and 4). The key sets 74 mate with keyways in the docking station as described below.

The other side 64 of the receptacle 12 is provided with protrusions that define sets of keyways 71 that mate with corresponding keys 81 in the docking station.

The docking station 25 includes opposing walls 35 and 37 that define several pairs of inwardly facing vertical channels 78 and 79 (FIG. 4). A pair of facing channels 78, 79 and the space between is considered a docking bay 26. A retractable prong 80 is positioned within the lower portion of each channel 78 and 79. The prong 80 is a spring member that normally extends into the channel toward the docking bay 26.

One of the channels of each bay 78 is provided with keys 81 formed therein to mate with keyways 71 of the receptacle 12. The other channel 79 of each bay is provided with sets of keyways 83 to mate with the key sets 74 on the other side of the receptacle 12.

The receptacle 12 is lowered into the station 25 and fits between the station walls 35, 37 with the above described keys and keyways mated. The keys and keyways are shaped so that the receptacle can be lowered into the station in only one orientation, thereby to ensure that the cartridges carried by the receptacle properly align with the fluid inlets 50 of the station 25.

Mating of the receptacle 12 and the docking bay 26 provide lateral support and stability to the receptacle when it is mounted on the printer. The retractable prongs 80 of each docking bay engage a detente recess 19 formed in the receptacle 12 wall to hold it firmly in place in the printer (FIG. 4). The receptacle can be removed by lifting it with sufficient force to retract the prongs to provide clearance between the receptacles and station 25.

In a preferred embodiment, the ink receptacle 12 includes a lower surface 47 extending from side 60 to side 62, substantially perpendicular thereto. Lower surface 47 additionally extends from side 64 to side 66 substantially perpendicular thereto, the surface 47 including an opening for fluid outlet 46. Lower surface 47 contacts and depresses an actuator 55 underlying the chamber when the ink cartridge is inserted in the receptacle. The actuator is connected to a transducer or sensor so that the depression of the actuator is converted into a signal indicative of the presence of a cartridge in the associated chamber 50 so that the printer microprocessor is apprised that a full ink supply is present.

When the receptacle 12 is mounted to the docking bay 26, ink cartridges 14 may be removed or inserted into the chambers 18 of the receptacle.

As shown in FIG. 3, ink cartridge 14 includes a flexible material layer attached along the periphery of each side of frame 28 so as to form a reservoir 32 to store ink. In a preferred embodiment, the reservoir is formed by heat staking a substantially rectangular plastic sheet along the perimeter of each side of frame 28 such that the interior portion of the frame is entirely enclosed, thereby defining reservoir 32.

The frame and fluid outlet 46 are molded of high density polyethylene and the plastic sheets are a metallized PET (polyethylene terephthalate). In the illustrated embodiment, the plastic sheets are heat staked to the faces of frame 28 in a manner well known to those in the art. The plastic sheets are, in the illustrated embodiment, multi-ply sheets having an outer layer of low density polyethylene, a layer of adhesive, a layer of metallized polyethylene terephthalate, a layer of adhesive, a second layer of metallized polyethylene terephthalate, a layer of adhesive, and an inner layer of low density polyethylene. The layers of low density polyethylene are about 0.0005 inches thick and the metallized polyethylene terephthalate is about 0.00048 inches thick. The low density polyethylene on the inner and outer sides of the plastic sheets can be easily heat staked to the frame while the double layer of metallized polyethylene terephthalate provides a robust barrier against vapor low and leakage. Of course, in other embodiments, different materials, alternative methods of attaching the plastic sheets to the frame, or other types of reservoirs might be used.

In the illustrated embodiment, the flexible ink reservoir 32 has the capacity to hold approximately 30 cc of ink. The cartridge 14 is sized so as to fit snugly within the space between the pressure plates 22 in each chamber 18 of the receptacle 12, and is sufficiently wide to allow force to be exerted upon the sides of ink reservoir 32 by pressure plates 22 when ink cartridge 14 is inserted into the receptacle 12. Other dimensions, shapes and materials for the cartridge 14 may be used depending on the particular dimensions of the receptacle 12.

The receptacle 12 includes a pair of retractable leaf springs 36 positioned within the lower portion of each chamber 18 on opposing walls (FIG. 3). The leaf springs 36 normally extend in a direction toward the interior portion of chamber 18. Each ink cartridge 14 includes detent recesses 37 positioned on the exterior, lower portion of frame 28. The detents are positioned on frame 28 such that, each leaf spring 36 within the chamber 18 will engage a detent recess 37 when an ink cartridge 14 is lowered into the chamber. The mating of each leaf spring 36 and the detent 37 will hold the ink cartridge 14 firmly in place within the chamber 18 of receptacle 12.

It is contemplated that the above-mentioned sets of keys 74, 81 and keyways 71, 83 (hereafter collectively referred to as "keying system") may be configured so that each bay has associated with it a key and keyway set that is unlike that of any other bay. This bay-specific keying system can be duplicated inside of each receptacle chamber 18 so that each chamber has the unique key and keyway set associated with the bay within which the chamber is located. It is also contemplated that the ink cartridges that are inserted into the chambers may carry on their frames 28 keys and keyways that mate with those of only one key chamber. Such cartridges therefore, could be used to ensure that a cartridge loaded with a particular color of ink will fit only in the chamber (and associated fluid inlet 50) that corresponds to the particular color.

In the absence of a keying system provided inside the receptacle chambers and cartridges, other systems, such as color coding, chamber shaping, or warning labels, may be used as a keying system.

The fluid outlet 46 of each ink cartridge includes a hollow cylindrical boss 52 that extends downward from the cartridge frame 28 (FIG. 3). The top of the boss 52 is in fluid communication with ink reservoir 32 such that ink may flow from the reservoir into the fluid outlet.

A spring 49 and sealing ball 48 are positioned within the boss 52 and held in place by a compliant septum 86 and a crimp cover 88. The length of the spring 49 is such that it can be placed into the inverted boss 52 with the ball 48 on top. The septum 86 can then be inserted into the boss 52 to compress the spring 49 slightly so that the spring biases the sealing ball 48 against the septum 86 to form a seal. The crimp cover 88 fits over the septum 86 and engages an annular projection 90 on the boss 52 to hold the entire assembly in place.

In the embodiment illustrated in FIG. 3, both the spring 49 and the ball 48 are stainless steel. The sealing ball 48 is sized such that it can move freely within the boss 52 and allow the flow of ink around the ball when it is not in the sealing position. The septum 86 is formed of polyisoprene rubber and has a concave bottom to receive a portion of the ball 48 to form a secure seal. The septum 86 is provided with a slit 92 so that it may be easily pierced without tearing or coring. However, the slit is normally closed such that the septum itself forms a second seal. The slit may, preferably, be slightly tapered with its narrower end adjacent the ball 48. The illustrated crimp cover 88 is formed of aluminum and has a thickness of about 0.020 inches. A hole 94 is provided so that the crimp cover 88 does not interfere with the piercing of the septum 86.

A fluid inlet 50 is positioned in each docking bay 26 and carried on a base plate 58 of the station 25. The fluid inlet 50 illustrated in FIG. 3 includes an upwardly extending needle 96 having a closed blunt upper end 64, a blind bore 98 and a lateral hole 68. A trailing tube (not shown) is connected to the lower end of the needle 96 such that the blind bore 98 is in fluid communication therewith. The trailing tube leads to the pen carried in the printer carriage.

A sliding collar 100 surrounds the needle 96 and is biased upwardly by a spring 72. The sliding collar 100 has a compliant sealing portion 102 with an exposed upper surface 104, and an inner surface 106 in direct contact with the needle 96. In addition, the illustrated sliding collar includes a substantially rigid portion 108 extending downwardly to partially house the spring 72. An annular stop 82 extends outward from the lower edge of the substantially rigid portion 108. The annular stop 82 is positioned beneath the base plate 58 such that it abuts the base plate to limit upward travel of the sliding collar 100 and define an upper position of the sliding collar on the needle 96. In the upper position, the lateral hole 68 is surrounded by the sealing portion 102 of the collar to seal the lateral hole and the blunt end 64 of the needle is generally even with the upper surface 104 of the collar.

In the embodiment illustrated in FIG. 3, the needle 96 is an eighteen gauge stainless steel needle with an inside diameter of about 1.04 mm, an outside diameter of about 1.2 mm, and a length of about 30 mm. The lateral hole is generally rectangular with dimensions of about 0.55 mm by 0.70 mm and is located about 1.2 mm from the upper end of the needle. The sealing portion 102 of the sliding collar is made of ethylene propylene dimer monomer (EPDM) and the generally rigid portion 104 is made of polypropylene or any other suitably rigid material. The sealing portion is molded with an aperture to snugly receive the needle and form a robust seal between the inner surface 106 and the needle 96. In other embodiments, alternative dimensions, materials or configurations might also be used.

As the ink supply cartridge 14 is inserted into the chamber 18 (hence, into docking bay 26), the bottom of the fluid outlet 46 pushes the sliding collar 100 downward. The needle 96 passes through the septum 86 to depress the sealing ball 48. Thus, in the fully inserted position, ink can flow from the boss 52, around the sealing ball 48, into the bore of the needle 96, through the trailing tube to the print head.

The force exerted by pressure plates 22 upon the sides of ink cartridge 14 cause the ink to flow from the ink reservoir 32 to the inlet. That is, when the cartridge is inserted in the receptacle, the flexible sides of the reservoir 32 are urged together by the spring biased pressure plates 22. Thus, when the ink cartridge is fully inserted into the receptacle 12 with outlet 46 aligned with inlet 50, ink within the cartridge is forced from the reservoir, through outlet 46, into inlet 50 and to the printhead.

Upon removal of the ink cartridge 14, the needle 96 is withdrawn and the spring 49 presses the sealing ball 48 firmly against the septum to establish a robust seal (FIG. 3). At the same time, the spring 72 pushes the sliding collar 100 back to its upper position in which the lateral hole 68 is encased within the sealing portion 102 of the collar to prevent the escape of ink from the fluid inlet 50.

To fill or refill the ink cartridge reservoir 32, ink can be injected through a fill port 110 in the cartridge frame 28. As ink is being introduced into the reservoir, a needle (not shown) can be inserted through the slit 92 in the septum 86 to depress the sealing ball 49 and allow the escape of any air from within the reservoir. Once the ink cartridge reservoir 32 is filled, a plug 114 is press fit into the fill port to prevent the escape of ink or the entry of air.

Of course, there are a variety of other ways which might also be used to fill the present reservoir. In some instances, it may be desirable to flush the entire ink supply with carbon dioxide prior to filling it with ink. In this way, any gas trapped within the ink supply during the filling process will be carbon dioxide, not air. This may be preferable because carbon dioxide may dissolve in some inks while air may not. In general, it is preferable to remove as much gas from the ink supply as possible so that bubbles and the like do not enter the print head or the trailing tube. To this end, it may also be preferable to use degassed ink to further avoid the presence of bubbles in the ink supply.

Figure 5:
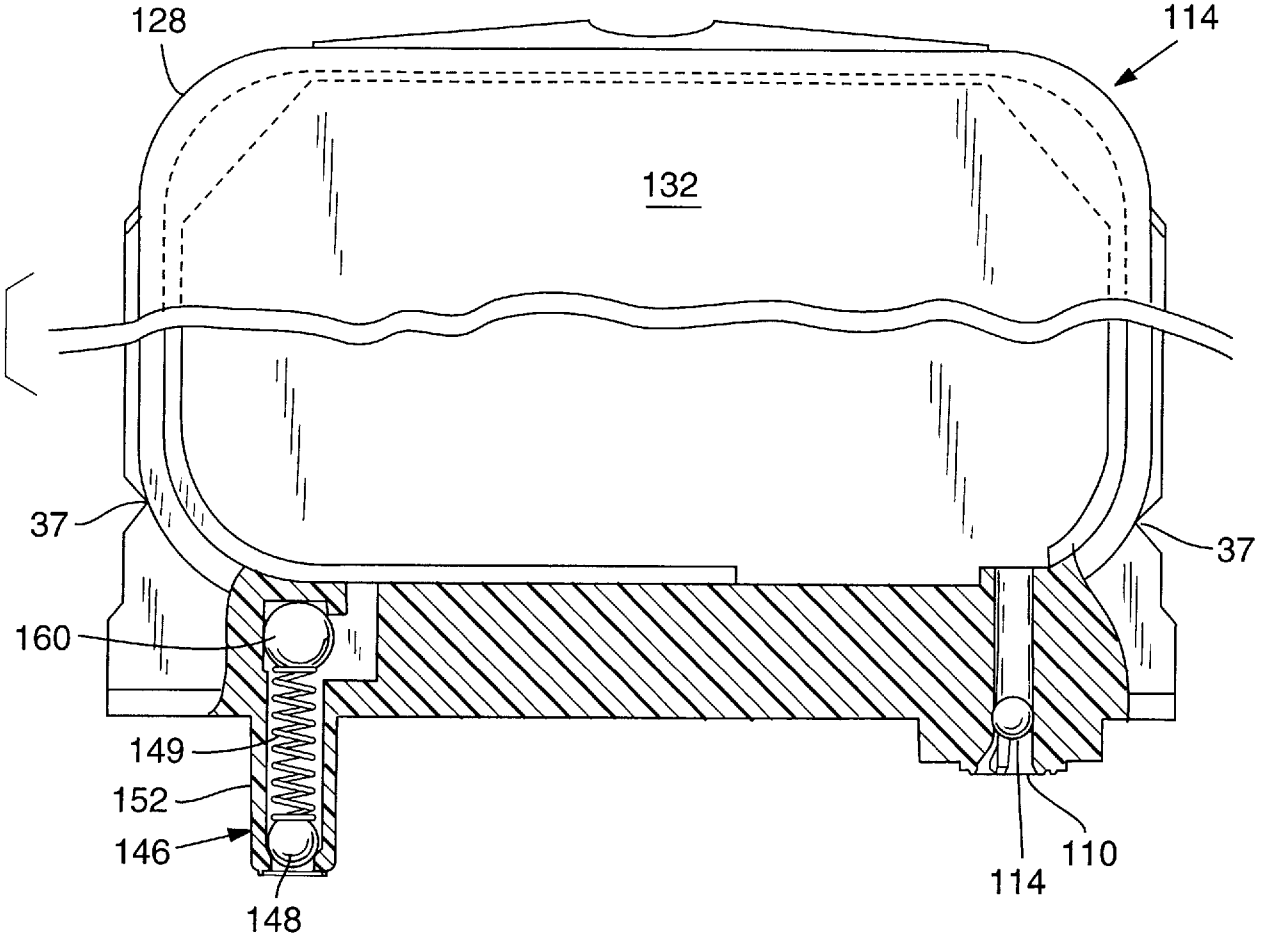
FIG. 5 is a cross-sectional side view of an alternative ink cartridge used with the adaptive ink supply.
Figure 6:
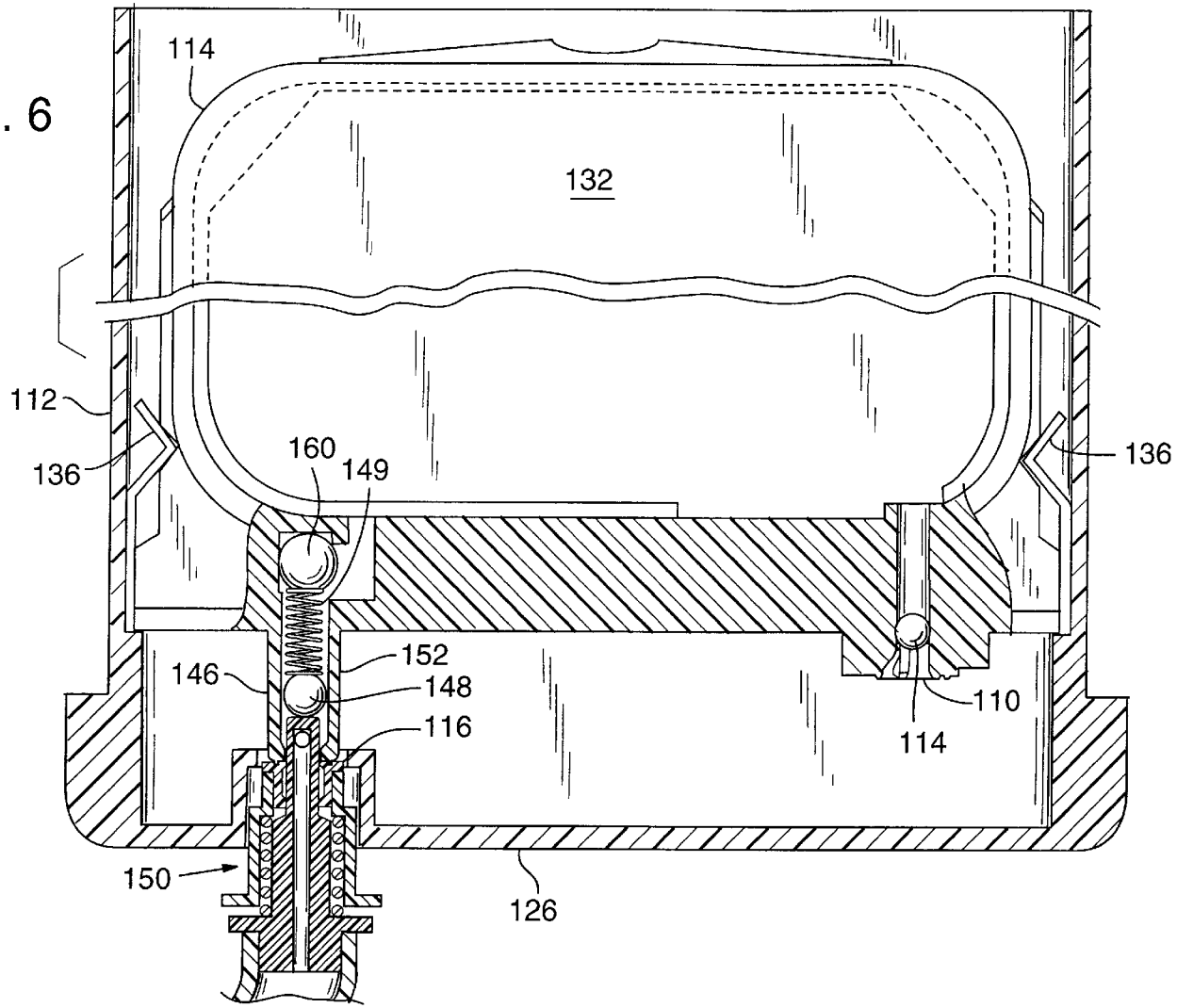
FIG. 6 is a cross-sectional side view of another preferred embodiment of an ink cartridge of the adaptive ink supply, the ink cartridge shown inserted in a receptacle that is docked in a docking bay of a printer.

An alternative embodiment of a cartridge 114 for the adaptive ink supply is illustrated in FIGS. 5 and 6. In the embodiment illustrated, a hollow cylindrical boss 152 extends downward from the ink cartridge frame 128 to form the housing of fluid outlet 146. A bore of the hollow boss 152 is in fluid communication with the reservoir 132 at its upper end and has a narrow throat at its lower end. A sealing ball 148, made of stainless steel in the illustrated embodiment, is positioned within the bore of the hollow boss 152. The sealing ball 148 is sized such that it may move within the bore, but cannot pass through the narrow throat.

A sealing spring 149 is positioned within the bore to urge the sealing ball 148 against the narrow throat to form a seal and prevent the flow of ink through the fluid outlet. The sealing spring 149 is retained in place by retaining ball 160. The bore is configured to allow the free flow of ink from the reservoir to the bore.

In the embodiment illustrated in FIG. 6, an alternative fluid inlet 150 of a docking bay 126 includes an extending hollow stud 116, the upper end of which has a cross hole that is contiguous with the interior of the stud. As the ink cartridge 114 is inserted into the receptacle 112 and into a docking bay, the stud 116 depresses the sealing ball 148 and enters through the throat and into the bore of outlet 146. In this manner, fluid can flow from ink reservoir 132, through the bore around the sealing ball 148 and into inlet 150. Fluid inlet 150 is connected to a conduit (not shown) which fluidly communicates with the printhead of the pen.

In another preferred embodiment of the present invention fluid outlet 46 is manufactured as a discrete part and attached to the bottom of frame 28 of ink cartridge 14 by conventional welding techniques such as, draw welding or sonic welding.

In another preferred embodiment of the present invention, the center-most portions of the pressure plates of the receptacle are bowed in a direction toward the center of the chamber, and no compression springs are attached to the plate. With such a shape, when an ink cartridge 14 is being inserted into the receptacle 12, the frame 28 of the cartridge will flatten the pressure plates. When the cartridge is fully inserted within the chamber of the receptacle, the pressure plates resile to exert pressure against the sides of the flexible reservoir.

Thus, when pressure plate is made of a sufficiently resiliently, flexible material, it operates like a leaf spring and exerts pressure on the reservoir 32 of an inserted ink cartridge 14. Additionally, with a bowed pressure plate the curved upper end of the pressure plate allows a smooth insertion of the ink cartridge into the receptacle.

Another preferred embodiment of the present invention includes a thin cross-shaped member adhered to the sides of the reservoir 32. The cross member distributes the pressure exerted by pressure plates 22 (FIG. 1) throughout the ink reservoir, once the cartridge is inserted within the receptacle 12.

Other embodiments of the present invention include the receptacle 12 with alternative biasing mechanisms. Pressure plates 22 may be biased by, for example, a Belleville spring, a flat triangular spring, several strategically placed coil-type springs, or with the pressure plate itself being a leaf spring or the like. Moreover, the cartridge receptacle walls could be formed to include resilient portions to carry out the function of the pressure plates.

Having illustrated and described the principles of the invention, it should be apparent to those persons skilled in the art that the illustrated embodiments may be modified without departing from such principles. For example, the receptacle chamber and ink cartridge size may be varied to provide a particular ink color in a larger quantity relative to the other ink colors. We claim as our invention all such embodiments that may come within the scope and spirit of the following claims and equivalents thereto.

I claim:

1. An adaptive ink supply for removable insertion into a docked position within an off-axis docking station of an ink-jet printer that has a fluid inlet coupled to a tube for supplying ink to a printhead, the adaptive ink supply comprising:

a receptacle mounted to the station for supporting at least one cartridge of ink in engagement with the inlet; and compression mechanism carried on the receptacle for pressurizing the ink within the cartridge.

2. The adaptive ink supply of claim 1 wherein the docking station and receptacle include a keying system for restricting the orientation of the receptacle relative to the station when the receptacle is mounted thereto.

3. The adaptive ink supply of claim 1 wherein the receptacle further includes an ink chamber for removably receiving an ink cartridge.

4. The adaptive ink supply of claim 1 wherein the compression means comprises a spring member carried in the chamber for compressing the cartridge.

5. The adaptive ink supply of claim 3 including an ink cartridge having a flexible ink reservoir for storing a quantity of ink, the ink reservoir being compressible when the ink cartridge is inserted in the receptacle.

6. The adaptive ink supply of claim 5 wherein the ink cartridge includes a fluid outlet for engaging the fluid inlet when the ink cartridge is inserted in a receptacle in the docked position.

7. The adaptive ink supply of claim 5 wherein the fluid outlet comprises a valve to allow the flow of ink through the fluid outlet when the ink cartridge is inserted in the receptacle and to prevent the flow of ink when the ink cartridge is not inserted in the receptacle.

8. A receptacle for an adaptive ink supply for insertion into a docked position within an off-axis docking bay of an ink-jet printer, the receptacle comprising:

a chamber having a space defined therein for receiving an ink cartridge; and a resilient member within the chamber and compressible for increasing the size of the chamber space.

9. The receptacle of claim 8 wherein the resilient member is at least one spring connected to a pressure plate, the spring urging the pressure plate toward a side of the chamber so that, when an ink cartridge is inserted in the chamber the pressure plate exerts pressure on the ink cartridge.

10. The receptacle of claim 8 including projecting keys for orienting the receptacle in the docking bay.

11. The receptacle of claim 10 wherein the projecting keys are shaped and positioned on the receptacle to correspond with mating keys on the docking bay.

12. An ink cartridge removably insertable into a receptacle mounted in a docked position on an ink-jet printer, the ink cartridge comprising:

a flexible ink reservoir for storing a quantity of ink;

a rigid frame having flexible walls attached thereto for defining the ink reservoir; and a fluid outlet connected to the frame in fluid connection with the reservoir.

13. The ink cartridge of claim 12 wherein the fluid outlet is positioned on the frame to allow the flow of ink from the ink reservoir to the printer when the ink cartridge is inserted in a receptacle.

14. The ink cartridge of claim 12 wherein the fluid outlet comprises a valve member to allow the flow of ink through the fluid outlet when the ink cartridge is inserted in the receptacle and to prevent the flow of ink when the ink cartridge is not inserted in the receptacle.

15. The ink cartridge of claim 12 wherein the fluid outlet engages a fluid inlet on an inkjet printer when the ink cartridge is inserted in a receptacle.

* * * * *

UNITED STATES PATENT AND TRADEMARK OFFICE

CERTIFICATE OF CORRECTION

PATENT NO. : 5,880,764
DATED : March 9, 1999
INVENTOR(S) : John A. Barinaga

It is certified that error appears in the above-identified patent and that said Letters Patent is hereby corrected as shown below:

Front page, Column 2,
Line 4, insert -- 5,541,995 9/1995 Swanson et al.--;

Signed and Sealed this

Twelfth Day of June, 2001

Nicholas P. Godici

*Attest:*

*Attesting Officer*

NICHOLAS P. GODICI
*Acting Director of the United States Patent and Trademark Office*